US005732318A

United States Patent [19]

Natsuhara et al.

[11] Patent Number: 5,732,318

[45] Date of Patent: Mar. 24, 1998

[54] HEATER AND HEATING/FIXING UNIT COMPRISING THE SAME

[75] Inventors: Masuhiro Natsuhara; Hirohiko Nakata, both of Hyogo, Japan

[73] Assignee: Sumitomo Electric Industries, Ltd., Osaka, Japan

[21] Appl. No.: 746,443

[22] Filed: Nov. 8, 1996

[30] Foreign Application Priority Data

Nov. 13, 1995 [JP] Japan ..... 7-294594
Oct. 28, 1996 [JP] Japan ..... 8-284999

[51] Int. Cl.[6] ..... G03G 15/20

[52] U.S. Cl. ..... 399/329; 399/335; 219/216

[58] Field of Search ..... 399/329, 328, 399/335; 219/216, 244, 409, 410, 464, 465, 466

[56] References Cited

U.S. PATENT DOCUMENTS 5,162,634 11/1992 Kusaka et al. ..... 219/216
5,278,618 1/1994 Mitani et al. ..... 219/216 X
5,365,314 11/1994 Okuda et al. ..... 219/216 X
5,499,087 3/1996 Hiraoka et al. ..... 219/216 X
5,660,750 8/1997 Kusaka ..... 219/216

FOREIGN PATENT DOCUMENTS 63-313182 12/1988 Japan .
1-263679 10/1989 Japan .
2-157878 6/1990 Japan .
5-135849 6/1993 Japan .
7-201455 8/1995 Japan .

*Primary Examiner*—R. L. Moses
*Attorney, Agent, or Firm*—W. G. Fasse; W. F. Fasse

[57] ABSTRACT

A ceramic heater fixes a toner image which is formed on a surface of a paper. A ceramic substrate is arranged to face the surface of the paper provided with the toner image. A heat generator is formed on a surface of the ceramic substrate which is opposite to that facing the surface of the paper. Thus, a structure of a heater which can be entirely uniformly heated to be capable of increasing a heating rate is provided with excellent fixability for a toner image.

13 Claims, 7 Drawing Sheets

HEATER AND HEATING/FIXING UNIT COMPRISING THE SAME

BACKGROUND OF THE INVENTION

1. Field of the Invention

The present invention relates to a heater and a heating/fixing unit comprising the same, and more specifically, it relates to a heater which is employed in a copying machine, a printer or the like for fixing a toner image formed on a surface of a transfer material such as a paper and a heating/fixing unit comprising the same.

2. Description of the Background Art

In general, a cylindrical heater is employed for fixing a toner image. FIG. 5 is a model diagram schematically showing the structure of a conventional heating/fixing unit. As shown in FIG. 5, the heating/fixing unit comprises a heating roller 25 of aluminum which is maintained at a prescribed temperature, and a pressure roller 8 which comes into pressure contact with the heating roller 25. A paper 9 which is a transfer material provided with a toner image is fed between the heating roller 25 and the pressure roller 8 to be heated and pressurized by these rollers, so that the toner image formed on the paper 9 is fixed. In this case, a cylindrical heater 20 itself rotates with the heating roller 25 along arrow R. The pressure roller 8 also rotates along arrow R. Thus, the paper 9 which is held between the heating roller 25 and the pressure roller 8 moves along arrow P.

As described above, the cylindrical heater 20 itself rotates to transmit heat to the paper 9 through the heating roller 25, thereby fixing the toner image. Therefore, not only the cylindrical heater 20 but the overall heating roller 25 of aluminum must be heated to a temperature capable of fixing the toner. Consequently, the heat capacity of the overall heater 20 must be increased, leading to increase in power consumption.

On the other hand, each of Japanese Patent Laying-Open Nos. 63-313182 (1988), 1-263679 (1989), 2-157878 (1990) and 5-135849 (1993) proposes a heating/fixing unit employing a plate-type heater having small heat capacity and a thin film. FIG. 6 is a model diagram schematically showing the structure of such a heating/fixing unit employing a plate-type heater. As shown in FIG. 6, the heating/fixing unit comprises a polyimide film 7 which is prepared from a heat-resistant resin film of polyimide resin, for example, and a pressure roller 8. The polyimide film 7 and the pressure roller 8 rotate along arrows R. A paper 9 provided with a toner image is held between the polyimide film 7 and the pressure roller 8, to move along arrow P. A plate-type ceramic heater 10 is fixed to the inner side of the rotating polyimide film 7. Heat is transmitted from the plate-type ceramic heater 10 to the paper 9 through the polyimide film 7. The surface of the pressure roller 8 is made of an elastic body (rubber, in general), and a constant load is applied by springs provided between a heating roller and the pressure roller 8, as described later. Thus, a load is applied to the paper 9, which is a transfer material, simultaneously with heating. Further, the surface of the pressure roller 8 is pressurized by this load, to define a contact part of a constant width $W_3$ on a portion opposed to the heater 10, as shown in FIG. 7. Due to the heat and the applied load, the toner image formed on the surface of the paper 9 is fixed. Thus, the heat capacity can be remarkably reduced by employing the plate-type heater 10 as compared with the cylindrical heater 20, whereby power consumption can be reduced.

FIG. 7 is a model diagram illustrating the structure of the heating/fixing unit shown in FIG. 6 in more detail. The ceramic heater 10 shown in FIG. 6 comprises a ceramic substrate 1, a heat generator 2, temperature detector electric circuit layers 3, a temperature detector 4 and a protective glass layer 5. The heat generator 2 is formed on a surface of the ceramic substrate 1 facing the paper 9. The ceramic heater 10 is fixed onto a heater receiver 6. The heat-resistant resin film 7 covers a surface of the fixed ceramic heater 10 and rotates along arrow R. Thus, the surface of the ceramic heater 10 facing the paper 9 slides with the resin film 7. Therefore, the protective glass layer 5 is formed over the surfaces of the heat generator 2 and the ceramic substrate 1 facing the resin film 7. The temperature detector 4 is provided on the opposite surface of the ceramic substrate 1 through the temperature detector electric circuit layers 3.

In case of transmitting heat onto the surface of the paper 9 from the ceramic heater 10 having the aforementioned structure, the heat is transmitted from the heat generator 2 to the protective glass layer 5, and to the paper 9 through the resin film 7. The protective glass layer 5 must be smooth and have a uniform thickness. If the protective glass layer 5 is not smooth or remarkably dispersed in thickness, fixability for the toner may be irregularized. In order to ensure insulation resistance between the heat generator 2 and the resin film 7, the thickness of the protective glass layer 5 must be at least several 10 μm.

FIGS. 8A and 8B illustrate a general pressurizing mechanism for the aforementioned fixation. FIG. 8A illustrates an internal section of the heating roller of the heating/fixing unit shown in FIG. 7, and FIG. 8B is a model diagram showing the pressurizing mechanism. Referring to FIGS. 8A and 8B, the shaft of the pressure roller 8 is held by a pressure roller receiver 81. The ceramic heater 10 is fixed to the heater receiver 6. A frame 61 of aluminum is fixed to the heater receiver 6, to form an outer frame of the heating roller. FIG. 8B shows a section as viewed from a direction perpendicular to the section shown in FIG. 8A. In other words, FIG. 8A shows only a heating roller side part of a section taken along the line A—A in FIG. 8B. FIG. 8B illustrates the internal structure of the heating roller shown in FIG. 8A, particularly the connection structure for the aluminum frame 61 and the pressure roller 8. Both ends of the aluminum frame 61 which is fixed to the heater receiver 6 are elastically supported by the fixed receiver 81 holding the shaft of the pressure roller 8 through springs 82. Thus, a constant load is elastically applied so that the heating roller comes into contact with the pressure roller 8 by the springs 82. Constant pressure is applied across the rollers due to the compressive force of the springs 82 and the rigidity of the aluminum frame 61, so that the contact part is defined by deformation of the elastic body (rubber, in general) forming the surface of the pressure roller 8. The paper 9 which is a transfer material is fed through a paper inlet port 83 shown in FIG. 8B. Referring to FIG. 8B, the heater receiver 6 (not shown) is present outside the inlet port 83 in practice, so that the heat-resistant resin film 7 such as a polyimide film, for example, travels along the heater receiver 6 and the pressure roller 8. Before the paper 9 which is a transfer material is introduced, the pressure roller 8 is in contact with the heat-resistant resin film 7.

FIG. 7 typically illustrates the relation between the widths $W_3$ and $W_2$ of the contact part and the ceramic substrate 1. Referring to FIG. 7, the ceramic heater 10 is illustrated in an enlarged manner, and hence the relation between the widths $W_3$ and $W_2$ of the contact part and the ceramic substrate 1 is slightly different from the actual one.

In the range of the width $W_3$ of the contact part, at least the lowest temperature which is necessary for fixing the toner is ensured in general, in spite of slight temperature distribution. At present, alumina ($Al_2O_3$) is mainly employed as the material for the heater substrate. In case of employing alumina, the width $W_3$ of the contact part is about 2 mm in general, when the paper 9 is fed at a low rate of 4 ppm, i.e., a rate for feeding four papers of the A4 size under Japanese Industrial Standards per minute. In this case, an alumina substrate of 9 mm in width, 270 mm in length and 0.635 mm in thickness is employed in general, and the width of the heat generator which is formed on this substrate is 1.5 mm in general. In order to ensure insulation, a space of at least 2.5 mm or 1.6 mm is provided on each side of the heat generator in case of using a power source of 200 V or 100 V.

When the feed rate (fixing rate) for the paper is increased, the width $W_3$ of the contact part must also be increased, as a matter of course. Under the present circumstances, therefore, the width of the heat generator provided on the ceramic substrate is simply increased while the diameter of the pressure roller or the load between the pressure roller and the heating roller is increased to increase the width of the contact part, thereby ensuring a distance of a soaking part capable of stably fixing the toner under a high feed rate.

Therefore, the width $W_3$ of the contact part, which is 2 mm when the fixing rate is 4 ppm as described above, must be 4 mm for a fixing rate of 8 ppm or 8 mm for a fixing rate of 16 ppm on the simple assumption that the temperature in the contact part is uniform. In practice, however, temperature distribution is caused in the contact part and hence the width of the heat generator must be increased to be slightly smaller than the width $W_3$ of the contact part for the purpose of safety. If the width of the heat generator is increased, the width $W_2$ of the alumina substrate provided with the heat generator must also be increased, as a matter of course. Consequently, power consumption of the heater is also increased due to the increase of the fixing rate.

On the other hand, an attempt is made to increase the load which is applied across the rollers for increasing the width $W_3$ of the contact part, thereby suppressing increase of the width of the heat generator and following increase of the width $W_2$ of the ceramic substrate while ensuring fixation quality.

However, assurance of the fixation quality by the aforementioned increase of the load is limited so far as the structure of the ceramic heater shown in FIG. 7 is employed. For example, a thermal shock which is applied to the ceramic substrate and the heat generator is also increased in this case, to reduce the lives of the ceramic substrate and the heat generator following the increase of the fixing rate. Further, friction between the surface of the ceramic heater and the heat-resistant resin film sliding therewith is increased, to remarkably damage the protective glass layer which is formed on the surface of the ceramic heater. In addition, the load on the paper which is a transfer material is also increased, to easily crinkle or damage the surface of the paper due to increase of the fixing rate.

Table 1 shows specifications for respective fixing rates simply designed with respect to the structure of the conventional ceramic heater employing an alumina substrate as hereinabove described. Referring to Table 1, values in relation to the fixing rates exceeding 8 ppm are estimated values.

TABLE 1

| Fixing Rate (ppm) | Substrate Width $W_2$ (mm) | Heat Generator Width (mm) | Load (kg) | Contact Part $W_3$ (mm) | Ratio $W_2/W_3$ |
|---|---|---|---|---|---|
| 4 | 9 | 1.5 | 4 | 2 | 4.50 |
| 6 | 9 | 2.0 | 6 | 3 | 3.00 |
| 8 | 9 | 2.5 | 8 | 4 | 2.25 |
| 16 | 12 | 6.0 | 13 | 8 | 1.50 |

Referring to Table 1, the widths $W_2$ of the substrates can be designed as 9 mm up to the fixing rate of 8 ppm. On the other hand, the frames of the heating rollers can be made of aluminum as shown in FIG. 8A up to the load of 6 kg, i.e., up to the fixing rate of 6 ppm, while the frames must be made of steel in order to increase rigidity when the loads exceed 8 kg, i.e., the fixing rates exceed 8 ppm.

Thus, various problems result from increase of the fixing rate, so far as the structure of the conventional ceramic heater employing an alumina substrate is employed.

In case of employing the structure of the conventional ceramic heater employing an alumina substrate, the most important subject for attaining increase of the fixing rate, in particular, is how to improve the thermal efficiency of the heater related to the protective glass layer. In general, glass has extremely low heat conductivity of not more than several W/mK. Therefore, the temperature of the protective glass layer 5 which is increased by the heat transmitted from the heat generator 2 is remarkably dispersed. Consequently, it is difficult to maintain the overall ceramic heater 10 at a constant temperature. Thus, it is difficult to uniformly fix the toner image which is formed on the surface of the paper 9.

Further, a unit for controlling the temperature of the ceramic heater 10 is necessary, to disadvantageously increase the manufacturing cost. In addition, the ceramic heater 10 requires a long time to reach a prescribed temperature.

If the thickness of the protective glass layer 5 is reduced in order to solve the aforementioned problem, on the other hand, the insulation resistance between the heat generator 2 and the resin film 7 is disadvantageously reduced.

SUMMARY OF THE INVENTION

Accordingly, an object of the present invention is to reduce temperature dispersion in a ceramic heater, for improving fixability for a toner image as well as a programming rate of the heater.

Another object of the present invention is to provide a structure of a ceramic heater which can follow future increase of a fixing rate while attaining the aforementioned object.

Still another object of the present invention is to provide a heating/fixing unit having a structure of a heater which can improve fixability for a toner image as well as the programming rate of a ceramic heater, and cope with increase of a fixing rate.

A heater according to the present invention is provided on a heating/fixing unit comprising a movably arranged heat-resistant film and a pressure roller for applying pressure onto the heat-resistant film for fixing a toner image formed on a surface of a transfer material which is held between and moves along the heat-resistant film and the pressure roller due to pressurization by the pressure roller and heating through the heat-resistant film, so that the heat-resistant film is slidable with the heater to be in close contact therewith. This heater comprises a ceramic substrate and a heat generator. The ceramic substrate is arranged to face the surface of the transfer material provided with the toner image. The heat generator is formed on a surface of the ceramic substrate which is opposite to that facing the surface of the transfer material.

Preferably, the heat generator is provided in the form of a plurality of lines on the surface of the ceramic substrate.

Preferably, the heat generator is provided in the form of a surface on the surface of the ceramic substrate.

The heat generator formed on the surface of the ceramic substrate, which is in the form of either lines or a surface, is preferably made of a complex containing at least one metal selected from a group consisting of noble metals such as silver, platinum, palladium and ruthenium and alloys thereof, or a complex containing at least one component selected from a group consisting of a carbide of Si, simple elements (Ti, Zr, Hf; V, Nb, Ta; Cr, Mo and W) belonging to the groups IVa, Va and IVa of the periodic table, and carbides, nitrides, borides and silicides of these elements, for example.

The heat conductivity of the ceramic substrate is preferably at least 50 W/mK. The ceramic substrate is prepared from a composite material, a multilayer substrate or a single plate having such heat conductivity.

The thickness of the ceramic substrate is preferably at least 0.4 mm and not more than 0.6 mm.

The ratio ($W_2/W_3$) of the width ($W_2$) of the ceramic substrate to the width ($W_3$) of a contact part defined between the heat-resistant film and the pressure roller is preferably not more than 1.4.

The ceramic substrate is mainly composed of aluminum nitride. Preferably, the ceramic substrate consists of an aluminum nitride sintered body, the mean diameter of particles forming the aluminum nitride sintered body is not more than 6.0 μm, and the flexural strength of the aluminum nitride sintered body is at least 40 kg/mm$^2$.

A control circuit and/or a control element for controlling the temperature of the heater is preferably formed on the surface of the ceramic substrate provided with the heat generator.

An element for detecting the temperature of the heater and/or its control circuit is preferably formed on a substrate which is different from the ceramic substrate provided with the heat generator, and this substrate is preferably provided immediately above the heat generator.

A heating/fixing unit according to another aspect of the present invention comprises a ceramic heater, a heat-resistant film, and a pressure roller. The heat-resistant film is arranged to slide in close contact with the ceramic heater. The pressure roller is adapted to apply pressure onto the heat-resistant film. The heating/fixing unit fixes a toner image formed on a surface of a transfer material which is held between and moves along the heat-resistant film and the pressure roller due to pressurization by the pressure roller and heating by the ceramic heater through the heat-resistant film. The ceramic heater includes a ceramic substrate and a heat generator. The ceramic substrate is arranged to face the surface of the transfer material provided with the toner image. The heat generator is formed on a surface of the ceramic substrate which is opposite to that facing the surface of the transfer material.

According to the present invention, the surface of the ceramic substrate which is opposite to that provided with the heat generator faces the surface of the transfer material provided with the toner image. Therefore, heat is transmitted to the transfer material such as a paper from the surface of the ceramic substrate provided with no heat generator. Due to this heat, the toner image provided on the transfer material is fixed. The surface of the ceramic substrate facing the transfer material is provided with neither heat generator nor glass layer for protecting such a heat generator. Thus, no glass layer having low heat conductivity is interposed between the heat generator and the transfer material, whereby the temperature of the overall heater can be readily uniformalized. Further, the temperature of the heater can be rapidly increased, too. Thus, the heat generated from the heat generator is diffused in the ceramic substrate to be capable of quickly heating the overall ceramic heater to a uniform temperature, whereby the temperature control of the heater can be simplified.

The temperature of the overall heater can be further uniformalized by forming the heat generator in the form of a plurality of lines or a surface on the surface of the ceramic substrate.

It is assumed that the heat generator provided on the surface of the ceramic substrate, which is in the form of either lines or a surface, is made of a complex containing at least one metal selected from a group consisting of noble metals such as silver, platinum, palladium and ruthenium and alloys thereof, or a complex containing at least one component selected from a group consisting of a carbide of Si, simple elements belonging to the groups IVa, va and iVa of the periodic table, and carbides, nitrides, borides and silicides of these elements, for example, so that the substrate can be uniformly heated by arranging the heat generator on a ceramic substrate mainly composed of aluminum nitride, for example. In this case, it is not necessary to control resistance every section of the heat generator, particularly when the heat generator is in the form of a surface. The former has such an advantage in manufacturing that the heat generator can be formed at a lower temperature as compared with the latter, while the latter advantageously attains heat resistance at a lower cost than the former.

When a material having heat conductivity of at least 50 W/mK is employed for the ceramic substrate, the temperature distribution of the overall heater can be further uniformalized. Such a material is selected from aluminum nitride, boron nitride, silicon carbide and composite materials thereof. Among these materials, aluminum nitride is most preferable in consideration of economy and the performance of the heater.

When the ceramic substrate is mainly composed of aluminum nitride, therefore, the ceramic substrate can be uniformly heated and its temperature can be rapidly increased. Particularly preferably, a material having heat conductivity of at least 100 W/mK, more preferably at least 200 W/mK, is employed so that the temperature of the ceramic substrate can be further quickly increased and the overall temperature distribution can be further uniformalized. Thus, a transfer body of a common toner fixing rate can be more quickly obtained with a quick start, and transfer strength can readily follow a high paper feed rate (a high ppm value (number of papers fed per minute), i.e., a high fixing rate operation). Further, transfer at higher fixing strength is enabled at a common fixing rate. Description is now made on the characteristics of the heater in case of employing $Al_2O_3$ (alumina) or AlN (aluminum nitride) as the material for the ceramic substrate.

The characteristics of the heater depend on the heat conductivity and the heat capacity of the ceramic substrate assuming that the power applied to the heat generator which is provided on the ceramic substrate remains unchanged. Namely, the ceramic substrate can be uniformly heated as its heat conductivity is increased, while its temperature can be rapidly increased as the heat capacity is reduced. Further, the heater temperature in a temperature rise process (not a stationary state but a transition period) is decided by a circuit serially connecting a resistor R and a capacitor C with each other assuming an electric equivalent circuit. Namely, the heater temperature is expressed as follows:

heater temperature$=1-e^{-1/Rc}$

R=1/heat conductivity(cal/cm·sec·K)

C=specific heat×density×volume(cal/K)

RC (cm·sec·) can be regarded as an exponent expressing fixability in case of employing the inventive heater for fixing a toner image. Table 2 shows characteristic values of alumina and aluminum nitride.

TABLE 2

| Material | $Al_2O_3$ | AlN | AlN | AlN |
|---|---|---|---|---|
| Heat Conductivity (W/mK) | 20 | 20 | 50 | 100 |
| Heat Conductivity (cal/cm · sec · K) | 0.0478 | 0.0478 | 0.1195 | 0.239 |
| Specific Heat (cal/g · K) | 0.19 | 0.16 | 0.16 | 0.16 |
| Density (g/cm$^3$) | 3.9 | 3.26 | 3.26 | 3.26 |
| Specific Heat × Density/Heat Conductivity | 15.5 | 10.9 | 4.36 | 2.18 |

When aluminum nitride having heat conductivity of at least 50 W/mK is employed as the material for the ceramic substrate, the value of (specific heat)×(density)/(heat conductivity) can be reduced below 5.0 as shown in Table 2, and the exponent expressing the fixability can be reduced.

In the heater according to the present invention, the heat generator is formed on the surface of the ceramic substrate which is opposite to that facing the transfer material, whereby the control circuit and/or the control element for controlling the heater temperature can be formed on the surface of the ceramic substrate provided with the heat generator. Therefore, an electric circuit pattern of the heat generator and a control circuit pattern can be formed on the surface of the ceramic substrate through the same step.

Further, the element for detecting the heater temperature or its control circuit is formed on a substrate which is different from that provided with the heat generator and this substrate is provided immediately above the heat generator, whereby responsibility of the temperature detector can be improved. If the temperature detector is provided on the same ceramic substrate as the heat generator, insulation between a temperature detector circuit and the heat generator circuit must be ensured. Thus, the temperature detector circuit must be separated from the heat generator circuit by a certain constant distance. Consequently, temperature difference results between the temperature detected by the temperature detector and the actual heater temperature. This temperature difference can be corrected by changing a method of controlling a unit for controlling a current which is fed to the heat generator. In this case, however, the responsibility for the temperature is deteriorated. When the temperature detector and/or the electric circuit for the temperature detector is formed on an insulating substrate which is different from the ceramic substrate and this insulating substrate is provided immediately above the heat generator, therefore, it is possible to improve the responsibility for the temperature.

When the ceramic substrate is prepared from an aluminum nitride sintered body, the mean diameter of particles forming the aluminum sintered body is not more than 6.0 μm and the flexural strength of the aluminum sintered body is at least 40 kg/mm$^2$, a ceramic substrate which is excellent in mechanical strength can be obtained. When such an aluminum nitride sintered body is employed, temperature difference indicating thermal shock resistance is increased by at least 50° C., and hence a substrate which is resistant against overheating in employment as well as against biased pressurization from the roller can be designed. The flexural strength is preferably increased so that warpage and waviness of the substrate are suppressed after printing and firing of the heat generator, electrodes and a glass member as described later, and the fixation is further uniformalized. In order to obtain an aluminum nitride sintered body of such high strength, it is necessary to optimize the particle diameters of AlN raw material, combination with a sintering assistant and the like and to sinter the material at a temperature of not more than 1800° C., preferably not more than 1700° C. Due to such high flexural strength, suppression of warpage and waviness and improvement of thermal shock resistance, further, a substrate having a thickness of 0.4 to 0.6 mm, which is smaller than that of 0.635 mm of the current substrate, can also be employed. Consequently, the heat capacity of the substrate is reduced so that power consumption of the heater is further reduced. Such characteristics have also been confirmed in case of employing boron nitride or silicon carbide as the material for the ceramic substrate.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
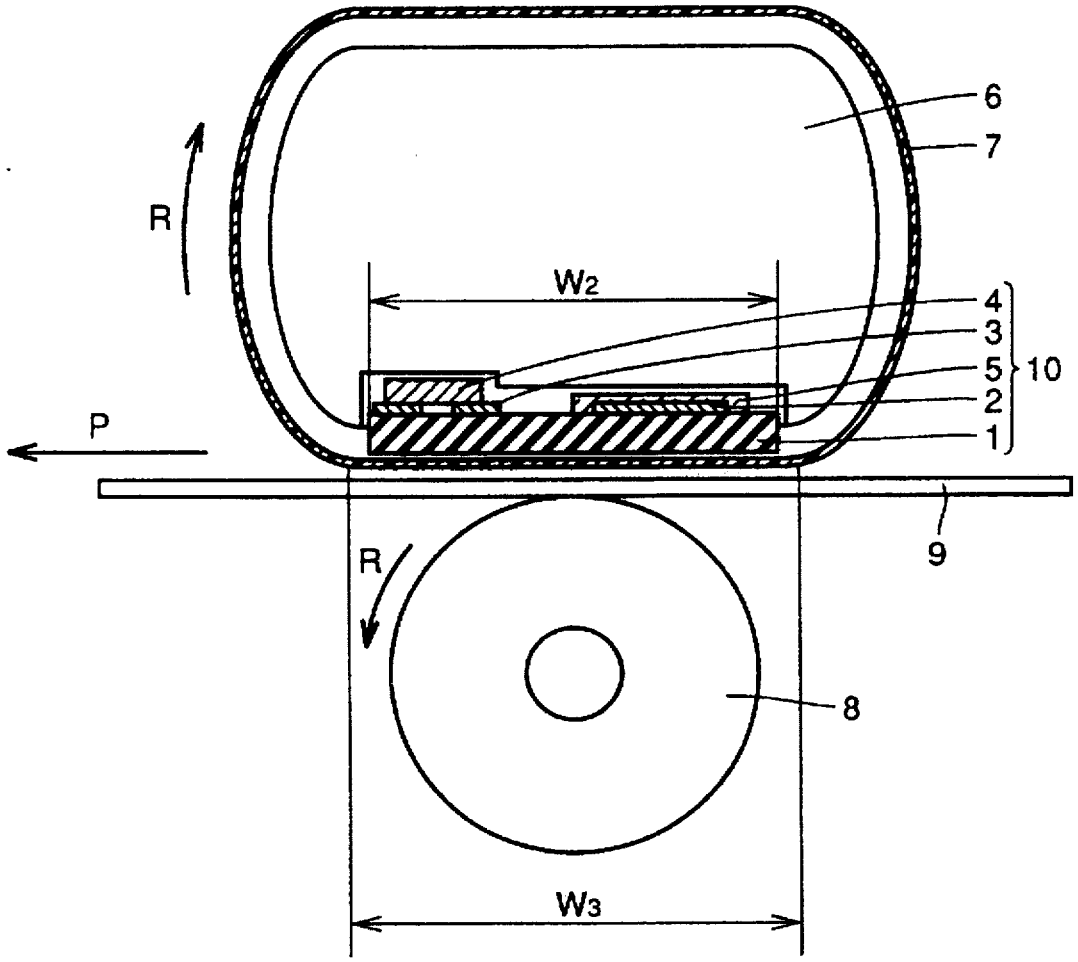
FIG. 1 is a model diagram schematically showing the structure of a heating/fixing unit integrated with a ceramic heater according to an embodiment of the present invention.

FIG. 1 is a model diagram schematically showing the structure of a heating/fixing unit comprising a ceramic heater according to an embodiment of the present invention. As shown in FIG. 1, a plate-type ceramic heater 10 is fixed to a heater receiver 6. A resin film 7 of polyimide or the like covers a surface of the plate-type ceramic heater 10, and is rotatable on the heater receiver 6 along arrow R. A pressure roller 8 of rubber is also rotatable along arrow R, with a paper 9 held between the same and the resin film 7.

The plate-type ceramic heater 10 comprises a ceramic substrate 1 consisting of an aluminum nitride sintered body, a heat generator 2, temperature detector electric circuit layers 3, a temperature detector 4, and a protective glass layer 5. The heat generator 2 and the temperature detector electric circuit layers 3, serving as control circuits for controlling the heater temperature, are formed on a surface of the ceramic substrate 1 which is opposite to that facing the paper 9. The protective glass layer 5 is formed to cover the heat generator 2. The temperature detector 4 is provided on the ceramic substrate 1 through the electric circuit layers 3.

In the heating/fixing unit having the aforementioned structure, heat generated from the heat generator 2 is uniformly diffused in the ceramic substrate 1, and transmitted to the paper 9 through the rotating resin film 7. Thus, a toner image which is formed on the paper 9 is fixed. The paper 9 is held and heated between the resin film 7 and the pressure roller 8 rotating in opposite directions, and moves along arrow P. Thus, an operation of fixing the toner image on the surface of the paper 9 is performed.

In the aforementioned embodiment, the surface of the ceramic substrate 1, consisting of an aluminum nitride sintered body, facing the paper 9 preferably has small surface roughness, wariness and warpage. If the surface of the ceramic substrate 1 facing the paper 9 is not smooth, i.e., if the surface roughness, wariness and warpage are large, it is difficult to uniformly bring the surface of the ceramic substrate 1 into contact with the surface of the resin film 7. Consequently, the heat transmitted to the ceramic substrate 1 is not uniformly transmitted to the paper 9 through the resin film 7. Thus, it is difficult to uniformly fix the toner image on the paper 9. In more concrete terms, the surface roughness of the ceramic substrate 1 is preferably not more than 5.0 μm in JIS ten-point average height roughness Rz, and the wariness and warpage are preferably not more than 2.0 mm.

While heat conductivity of the ceramic substrate 1 is effectively maximized, the temperature distribution of the overall heater 10 is relatively excellent if the heat conductivity is at least 50 W/mK. As hereinabove described, such a ceramic material is prepared from aluminum nitride, boron nitride, silicon carbide or a composite material thereof. However, boron nitride is high-priced, while a simple substance of silicon carbide has such low electric insulation that an insulating film must be formed on its surface for employment. Therefore, aluminum nitride is the most preferable material. If the heat conductivity is lower than 50 W/mK, a long time is required for transmitting the heat generated in the heat generator 2 to the surface of the ceramic substrate 1 facing the paper 9. If the heat conductivity is lower than 50 W/mK, further, the temperature of the ceramic substrate 1 increased by the heat generated from the heat generator 2 is unpreferably dispersed.

Since the operating temperature of the heater 10 is about 200° C., the material for the heat generator 2, which is applied onto the ceramic substrate 1, can be prepared from a metal material such as a compound of Ag—Pd, Pt—Pd or Ru, or a high melting point metal such as W or Mo, as described above. After the heat generator 2 is baked on the ceramic substrate 1, the protective glass layer 5 is formed for protecting the circuit pattern of the heat generator 1 and ensuring insulation. The protective glass layer 5 can be made of any glass material so far as the same contains no component reacting with aluminum nitride in case of preparing the substrate 1 from aluminum nitride. In order to ensure excellent adhesion to the aluminum nitride forming the ceramic substrate 1, the material for the protective glass layer 5 preferably contains an oxide of an element belonging to the group IIa, IIIa or IIIb of the periodic table. However, it is unpreferable to introduce an oxide having conductivity into the material for the protective glass layer 5, since the withstand voltage across the circuits is reduced in this case.

Electrodes for the heat generator 2 and the temperature detector electric circuit layers 3 are formed by Ag paste or the like on the surface of the ceramic substrate 1 provided with the heat generator 2.

In the heating/fixing unit having the aforementioned structure, the surface of the ceramic substrate 1 provided with no heat generator 2 etc. comes into contact with the surface of the resin film 7 of polyimide or the like. While the ceramic substrate 1 consisting of an aluminum nitride sintered body directly comes into contact with the resin film 7, the temperature dispersion on the contact surface is extremely small due to excellent heat conduction of the aluminum nitride sintered body, whereby a heating/fixing unit having uniform temperature distribution can be implemented.

Figure 2:
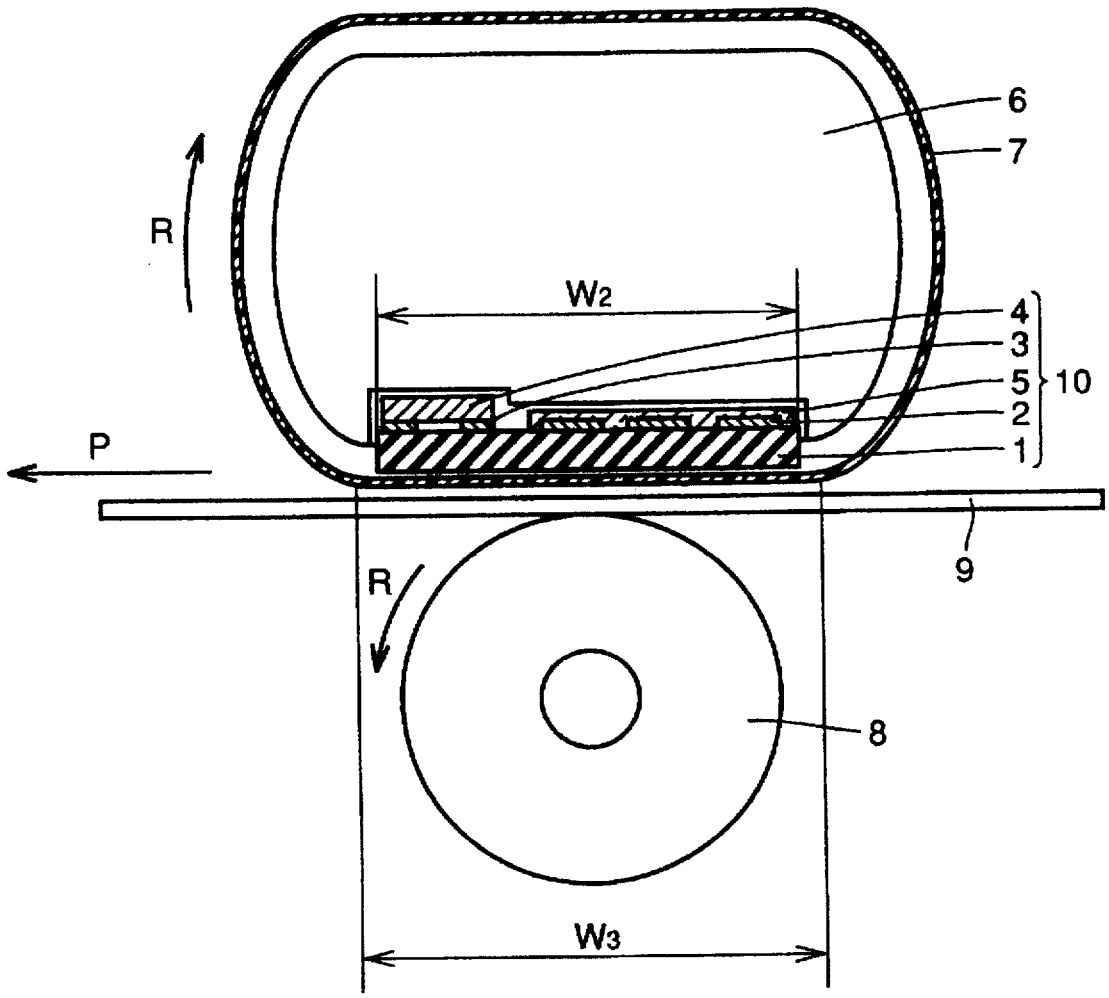
FIG. 2 is a model diagram schematically showing the structure of a heating/fixing unit integrated with a ceramic heater according to another embodiment of the present invention.

FIG. 2 is a model diagram schematically showing the structure of a heating/fixing unit comprising a ceramic heater according to another embodiment of the present invention. As shown in FIG. 2, this structure is different from that of FIG. 1 in a point that a plurality of heat generators 2 are formed on a surface of a ceramic substrate 1 which is opposite to that facing a paper 9. Due to the plurality of linear heat generators 2 formed on the surface of the ceramic substrate 1, it is possible to uniformly heat the ceramic substrate 1. Thus, uniform heating of the ceramic substrate 1 can be implemented.

Figure 3A:
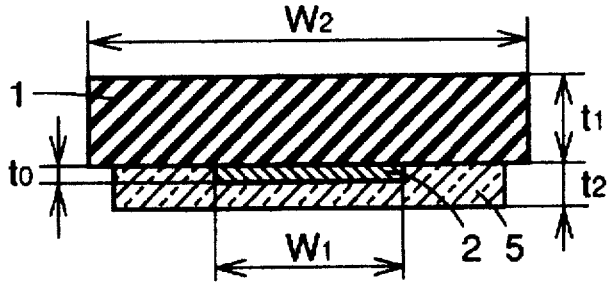
FIG. 3A PRIOR ART
FIG. 3A is a sectional view showing the structure of a conventional ceramic heater employed for approximately calculating heat resistance.
Figure 3B:
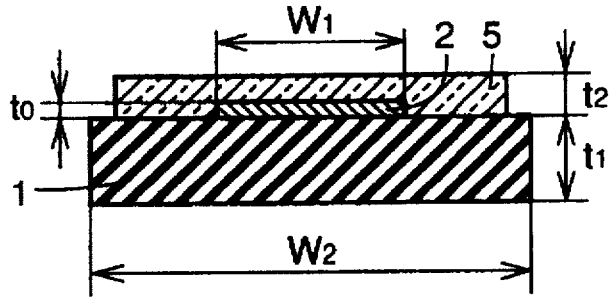
FIGS. 3B and 3C are sectional views showing the structures of ceramic heaters according to the present invention.
Figure 3C:
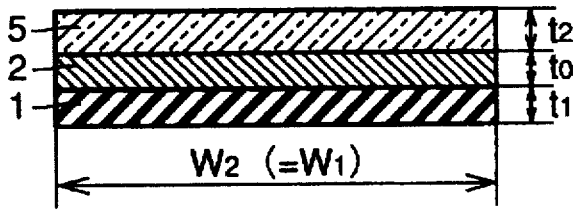

FIGS. 3A to 3C are sectional views schematically showing the structures of conventional and inventive plate-type ceramic heaters respectively. As shown in FIG. 3A, a heat generator 2 is formed on a surface (lower surface in the figure) of a ceramic substrate 1 facing a paper in the conventional plate-type ceramic heater. A protective glass layer 5 is formed to cover the heat generator 2. As shown in FIG. 3B, on the other hand, the heat generator 2 is formed on the surface (upper surface in the figure) of the ceramic substrate 1 which is opposite to that facing the paper 9 in the ceramic heater according to one embodiment of the present invention. The protective glass layer 5 is formed to cover the heat generator 2.

FIG. 3C illustrates the structure of a ceramic heater according to still another embodiment of the present invention. In this ceramic heater, a heat generator 2 is formed on the overall surface of a ceramic substrate 1. A protective glass layer 5 is formed on the heat generator 2. Such a ceramic heater is called a bulk heater.

Figure 3D:
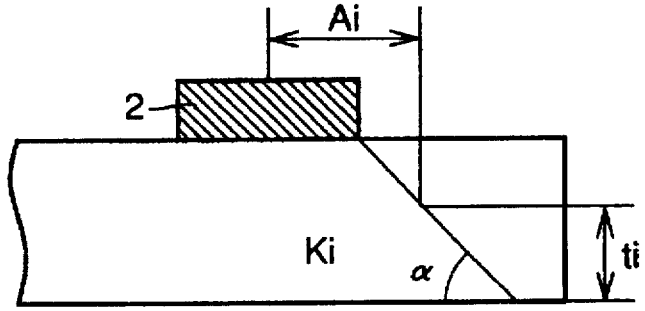
FIG. 3D illustrates prerequisites for approximate calculation of heat resistance.

As to the aforementioned three types of plate-type ceramic heaters, resistance values of heat transmitted to the papers provided with toner images are approximately calculated. FIG. 3D shows a method of approximately calculating heat resistance, in accordance with the following approximate calculation expressions:

$$Ri = \frac{t_i}{\pi K_i A_i (A_i + t_i)}$$

$$R_{th} = \Sigma R_i$$

t:thickness A:width K:heat conductivity

As shown in FIG. 3D, it is assumed that heat is transmitted in a direction of an angle α of 45° from each heat generator 2. It is also assumed that K represents the heat conductivity of the material receiving the heat from the heat generator 2. In the above expressions, Ri represents heat resistance up to a position of a width Ai and a thickness ti, and Rth represents the overall heat resistance.

In the approximate calculation of heat resistance, the dimensions of the respective ceramic heaters are set as follows: In the conventional ceramic heater shown in FIG. 3A, the heat generator 2 has a thickness $t_0$ of 0.01 mm and a width $W_1$ of 1.5 mm, the ceramic substrate 1 has a thickness $t_1$ of 0.635 mm and a width $W_2$ of 9.0 mm, and the protective glass layer 5 has a thickness $t_2$ of 0.080 mm. In the inventive ceramic heater shown in FIG. 3B, the heat generator 2 has a thickness $t_0$ of 0.01 mm and a width $W_1$ of 1.5 mm, the ceramic substrate 1 has a thickness $t_1$ of 0.635 mm and a width $W_2$ of 9.0 mm, and the protective glass layer 5 has a thickness $t_2$ of 0.080 mm. In the inventive bulk heater shown in FIG. 3C, the heat generator 2 has a thickness $t_0$ of 0.3 mm, the ceramic substrate 1 has a thickness $t_1$ of 0.4 mm and a width $W_2$ of 9.0 mm, and the protective glass layer 5 has a thickness $t_2$ of 0.080 mm.

Table 3 shows heat resistance values approximately calculated as to the structures of the respective heaters.

TABLE 3

| Heater Structure | FIG. 3A | FIG. 3B | FIG. 3C |
|---|---|---|---|
| Substrate Material | $Al_2O_3$(AlN) | AlN | AlN |
| Heat Resistance (°C/W) | 8.19 | 1.15 | 0.045 |

As clearly understood from Table 3, the ceramic heater having the structure of FIG. 3B according to the present invention exhibits a lower heat resistance value as compared with the conventional ceramic heater shown in FIG. 3A. The heat resistance value of the ceramic heater shown in FIG. 3A remains unchanged whether the ceramic substrate 1 is made of $Al_2O_3$ or AlN. This is because the heat resistance value is calculated only with respect to heat which is generated from the heat generator 2 and downwardly transmitted in the figure, i.e., toward the paper. In practice, however, the heat is also transmitted to the alumina or aluminum nitride forming the ceramic substrate 1 in the structure shown in FIG. 3A. In this case, the heat is transmitted at a higher speed and temperature rise/soaking more quickly advances in the aluminum nitride, and hence actual heat resistance is considerably reduced when the aluminum nitride is employed as compared with alumina also in the structure shown in FIG. 3A. When the heater has the structure shown in FIG. 3C, on the other hand, the heat resistance is further reduced. The aforementioned heat transmission characteristics also apply to the case of employing boron nitride or silicon carbide.

When the material for the ceramic substrate is prepared from aluminum nitride in the heat transmission direction, i.e., the direction of the paper provided with the toner image, in the plate-type ceramic heater, the heat resistance can be further reduced in this direction in the plate-type ceramic heater. Further, it is possible to further reduce the heat resistance along this direction by providing the heat generator not in the form of lines but in the form of a surface on the surface of the ceramic substrate.

Figures 4A, 4B, 4C, 4D:
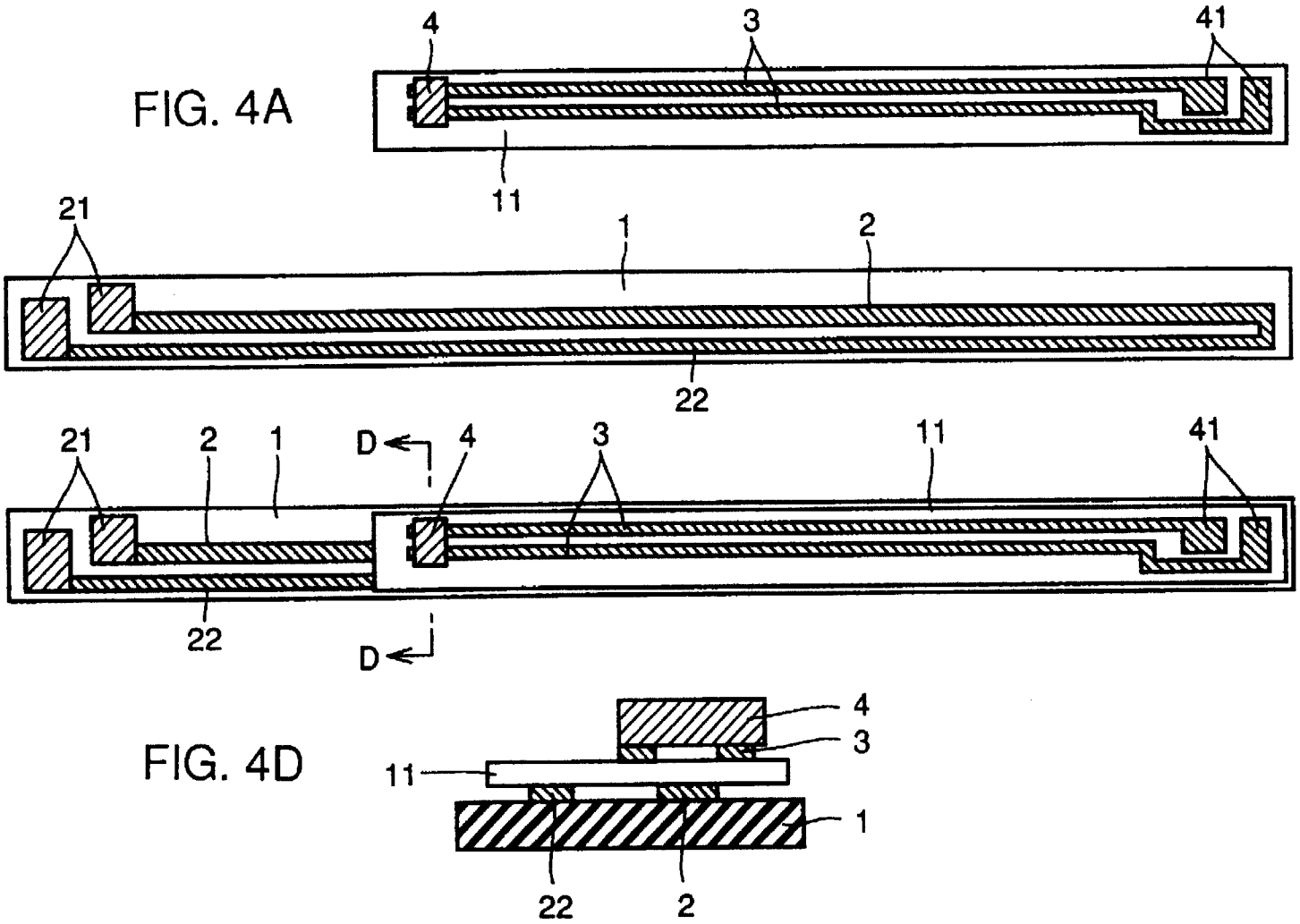
FIG. 4A is a plan view of an insulating substrate provided with a temperature detector in a ceramic heater according to a further embodiment of the present invention.
FIG. 4B is a plan view of a ceramic substrate provided with a heat generator.
FIG. 4C is a plan view of the insulating substrate provided on the ceramic substrate.
FIG. 4D is a sectional view taken along the line D—D in FIG. 4C.
Figure 5:
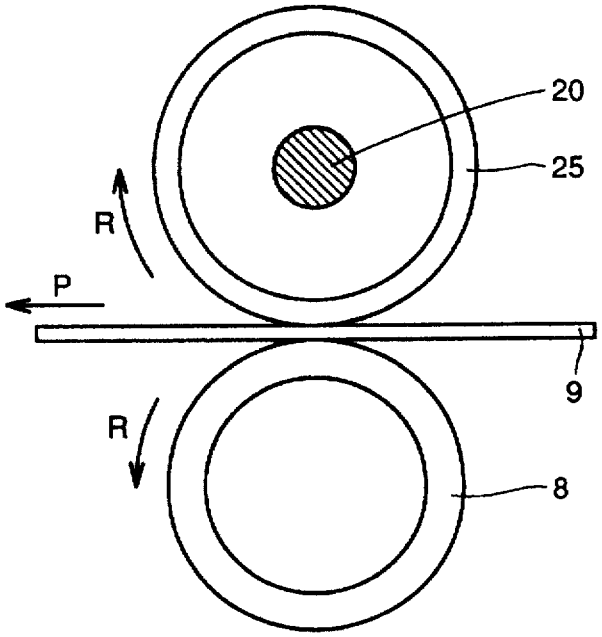
FIG. 5 PRIOR ART
FIG. 5 is a model diagram schematically showing the structure of a conventional heating/fixing unit integrated with a cylindrical heater.
Figure 6:
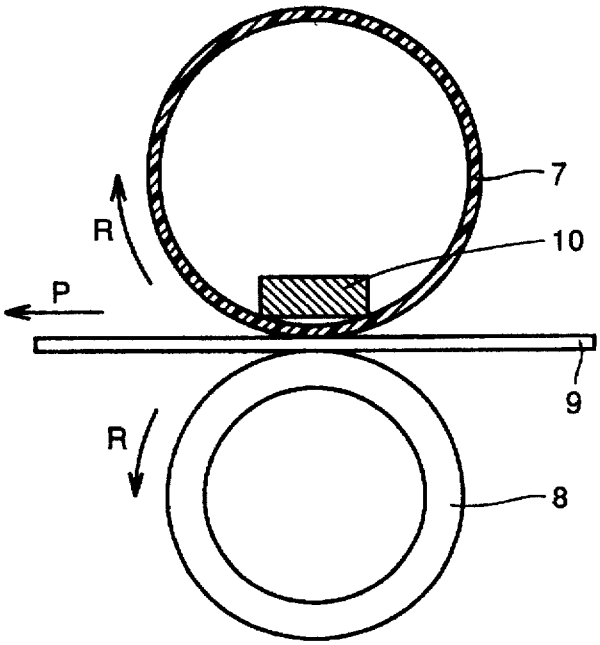
FIG. 6 PRIOR ART
FIG. 6 is a model diagram schematically showing the structure of a conventional heating/fixing unit integrated with a plate-type ceramic heater.

FIGS. 4A to 4D illustrate a ceramic heater according to a further embodiment of the present invention. As shown in FIG. 4A, temperature detector electric circuit layers 3 are formed on a surface of an insulating substrate 11. Electrode layers 41 are connected to first ends of the temperature detector electric circuit layers 3. A temperature detector 4 is provided on second ends of the temperature detector electric circuit layers 3. In this case, the insulating substrate 11 can be made of $Al_2O_3$, $ZrO_2$, glass, $Si_3N_4$ or AlN. Conductors employed for the electric circuit layers 3 provided in the vicinity of the heater are preferably prepared from a metal which is hard to oxidize such as a noble metal such as Ag, Au or Pt or an alloy thereof.

As shown in FIG. 4B, a heat generator 2 is formed on a surface of a ceramic substrate 1 consisting of an aluminum nitride sintered body. An electric circuit layer 22 is formed on the surface of the ceramic substrate 1 to be connected to and extend in parallel with the heat generator 2. Electrode layers 21 are formed to be connected with first end portions of the heat generator 2 and the electric circuit layer 22 respectively.

The insulating substrate 11 which is structured as shown in FIG. 4A is arranged on the ceramic substrate 1 having the heat generator 2 which is structured as shown in FIG. 4B. FIG. 4C is a plan view showing the ceramic heater having this structure. FIG. 4D is a sectional view taken along the line D—D in FIG. 4C. As shown in FIG. 4D, the temperature detector 4 is located immediately above the heat generator 2 through the insulating substrate 11. Thus, responsibility for temperatures can be improved.

In this case, the insulating substrate 11 may simply be provided on the heat generator 2, and the ceramic substrate 1 may be connected with the insulating substrate 11 by any method.

For example, the prescribed heat generator 2, the electric circuit layer 22 and the electrode layers 21 are formed on the ceramic substrate 1 by thick film screen printing. Then, the electric circuit layers 3 and the electrode layers 41 are formed also on the surface of the insulating substrate 11 by a similar method to the above. Thereafter the insulating substrate 11 is placed on a prescribed position of the ceramic substrate 1, and fired in the atmosphere. Thus, the heat generator 2, the electric circuit layer 22 and the electrode layers 21 can be baked onto and connected with both of the ceramic substrate 1 and the insulating substrate 11.

As another method of connecting the ceramic substrate 1 with the insulating substrate 11, the heat generator 2, the electric circuit layer 22, the electrode layers 21, the electric circuit layers 3 and the electrode layers 41 are separately baked onto both of the ceramic substrate 1 and the insulating substrate 11. Thereafter an overcoat glass layer for protecting the heat generator 2 is baked and dried on the ceramic substrate 1. The insulating substrate 11 is fixed to a prescribed position on the ceramic substrate 1, and the glass is baked. The glass is baked to both substrates, whereby the ceramic substrate 1 and the insulating substrate 11 can be connected to each other.

EXAMPLE 1

Figure 7:
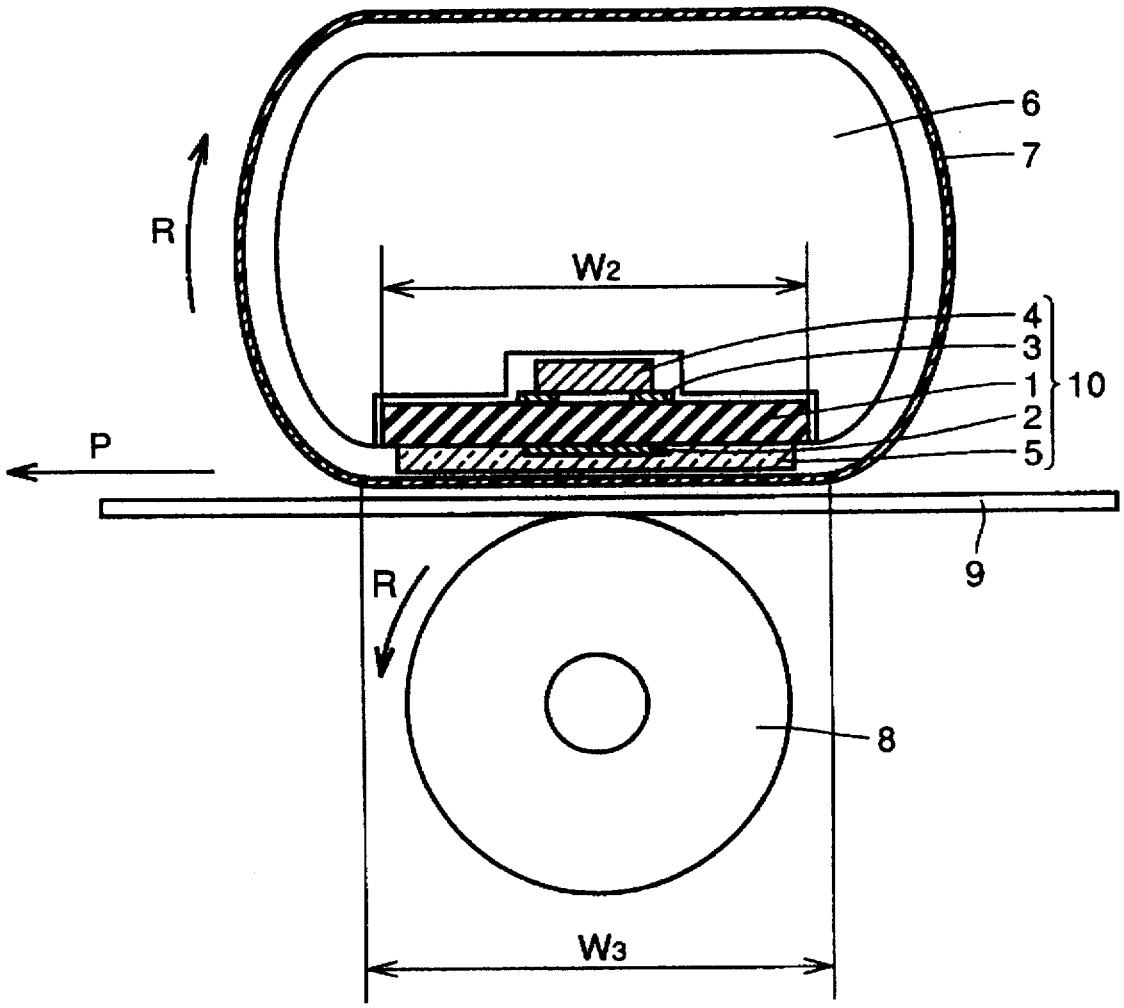
FIG. 7 PRIOR ART
FIG. 7 is a model diagram schematically showing the structure of the conventional heating/fixing unit integrated with a plate-type ceramic heater in more detail.
Figure 8A:
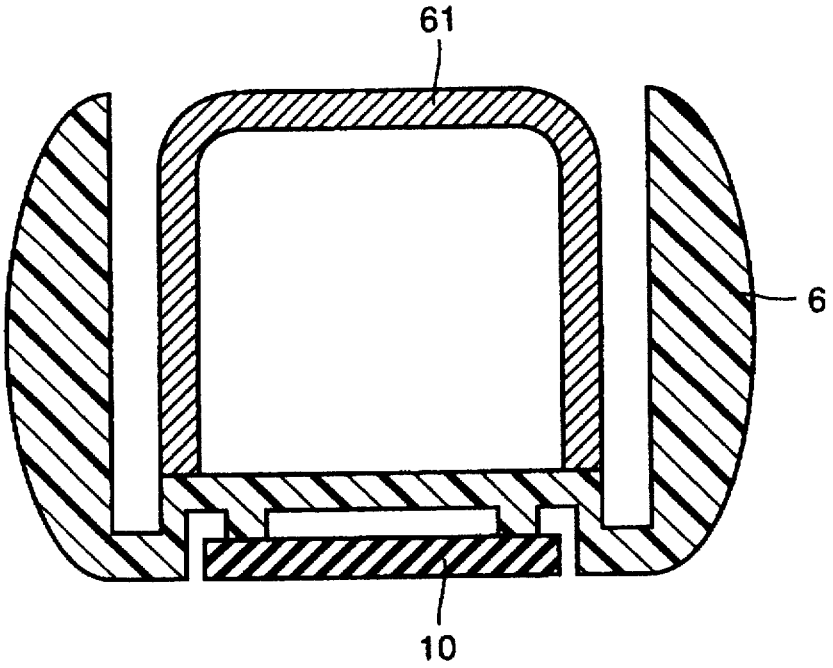
FIG. 8A PRIOR ART
FIGS. 8A and 8B are model sectional views schematically showing the structure of a pressurizing mechanism between a heating roller and a pressure roller in a heating/fixing unit according to the present invention.
Figure 8B:
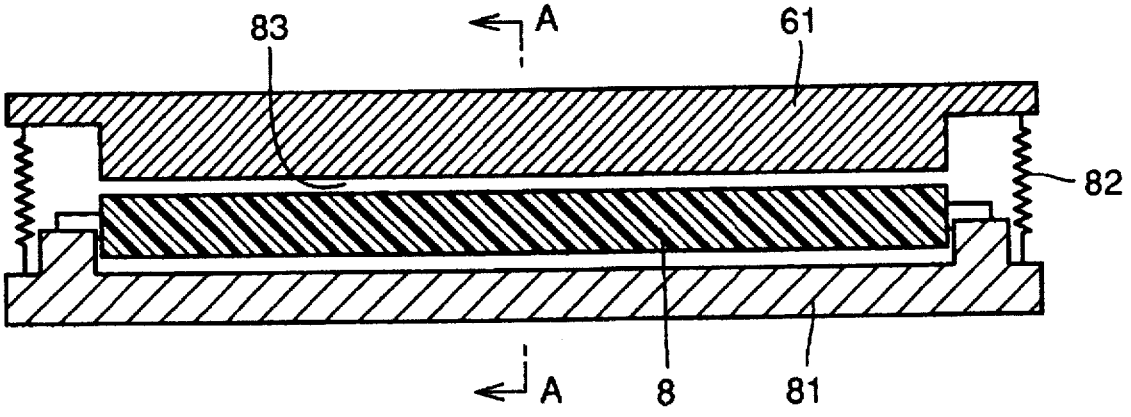
FIG. 8B PRIOR ART

Samples of the ceramic heaters shown in FIGS. 1, 2 and 7 were prepared by employing $Al_2O_3$ and AlN as the materials for the ceramic substrates. Each sample of the ceramic heaters was prepared in the following method:

A ceramic substrate 1 of 300 mm by 10 mm by 0.7 mm was prepared from an $Al_2O_3$ or AlN sintered body. Its surface was finished into 2 μm in ten-point average height roughness Rz, and paste mainly composed of a noble metal such as Ag or Pt was applied onto a prescribed position of the substrate by screen printing, thereby forming a heat generator 2. Paste containing a metal component such as Ag was applied onto a prescribed position by screen printing, thereby forming an electrode connected to the heat generator 2. Further, Ag-Pd was applied onto the substrate 1 by screen printing, thereby forming temperature detector electric circuit layers 3. A temperature detector 4 was provided on the temperature detector electric circuit layers 3. Thereafter the ceramic substrate 1 was fired in the atmosphere at a temperature of 900° C. At this time, the resistance value of the heat generator 2 was set at 20 Ω. Glass was applied to the fired ceramic substrate 1 by screen printing for protecting the electric circuit layers 3 and the heat generator 2, and fired in the atmosphere at a temperature of 600° C. Thus, a protective glass layer 5 of 60 μm in thickness was formed. At this point of time, the substrate 1 exhibited longitudinal warpage and wariness of 1.8 mm and 2.0 mm respectively.

The AlN sintered body employed in the aforementioned method of preparing each ceramic heater was prepared as follows:

0.8 parts by weight of a sintering assistant was added to 100 parts by weight of AlN powder with addition of prescribed amounts of an organic binder and an organic solvent, and these materials were mixed with each other by a ball mill mixing method. Thereafter the obtained slurry was sheet-formed by a doctor blade coater. The obtained sheet was cut into prescribed dimensions, and degreased in a non-oxidizing atmosphere at a temperature of 800° to 900° C. Alternatively, the sheet may be degreased in an oxidizing atmosphere such as the atmosphere at a temperature of not more than 600° C. If the degreasing is performed in an oxidizing atmosphere at a temperature exceeding 600° C., oxidation reaction unpreferably progresses on the AlN powder surface to reduce heat conductivity of the obtained sintered body. The degreased sheet was fired in a non-oxidizing atmosphere at a temperature of 1700° to 1900° C. Thus, it was possible to obtain a sintered body having small particle diameters and high flexural strength. The AlN sintered body prepared in the aforementioned manner exhibited heat conductivity of about 170 W/mK, flexural strength of 30 kg/mm$^2$ and a mean particle diameter of 8 μm.

In the aforementioned method of preparing the AlN sintered body, the diameters of the particles forming AlN are increased as the sintering temperature is increased. While the particle diameters are also increased as the sintering time is increased, the influence by the sintering temperature is larger than that by the sintering time. The AlN sintering body is formed by bonding of the particles. The flexural strength of the AlN sintered body is in proportion to the bonding strength between the particles and the connection areas of the particles. When sintering is performed at a low temperature, the particle diameters are reduced and surface areas of the particles per unit volume are also relatively increased due to no particle growth. Consequently, connection (bonding) areas between the particles are also increased, whereby a sintered body having relatively high strength can be obtained.

Samples of the heating/fixing units shown in FIGS. 1, 2 and 7 were prepared by employing the samples of the ceramic heaters shown in these figures prepared in the aforementioned manner. In the samples of the ceramic heaters shown in FIGS. 1 and 7, the heat generators 2 were 1.5 mm in thickness, while the sample of the ceramic heater shown in FIG. 2 was provided with three linear heat generators 2 of 0.5 mm in width. The respective samples of the heating/fixing units were subjected to evaluation of fixability levels for toner images with respect to papers. The fixability of each sample was evaluated as follows: A toner was applied to the overall surface of a paper of the A4 size under Japanese industrial Standards, which was in a state before introduction into a fixing unit of a printer. The toner was fixed to the paper by the sample of the ceramic heater shown in each of FIGS. 1, 2 and 7. The fixing rate was set by adjusting the speed of a motor for driving the pressure roller 8. The width $W_3$ of the contact part defined between the heat-resistant resin film 7 and the pressure roller 8 and the load for fixation were set at levels shown in Table 1 in response to the fixing rate.

Table 4 shows conditions in and results of the evaluation test.

TABLE 4

| Fixing Rate (ppm) | Fixing Load (kg) | Contact Part Width $W_3$ (mm) | Substrate Width $W_2$ / Contact Part Width $W_3$ | Paper No. | $Al_2O_3$ FIG. 7 20 W/mK | $Al_2O_3$ FIG. 1 20 W/mK | $Al_2O_3$ FIG. 2 20 W/mK | AlN FIG. 7 170 W/mK | AlN FIG. 1 170 W/mK | AlN FIG. 2 170 W/mK |
|---|---|---|---|---|---|---|---|---|---|---|
| 4 | 4 | 2 | 5 | 1 | ○ | ○ | Δ | ○ | ○ | ○ |
| | | | | 2 | ○ | ○ | ○ | ○ | ○ | ○ |
| | | | | 4 | ○ | ○ | ○ | ○ | ○ | ○ |
| 8 | 4 | 2 | 5 | 1 | X | X | Δ | ○ | ○ | ○ |
| | | | | 4 | X | Δ | Δ | ○ | ○ | ○ |
| | | | | 8 | X | Δ | ○ | ○ | ○ | ○ |
| | 8 | 4 | 2.5 | 1 | ○ | ○ | ○ | ○ | ○ | ○ |
| | | | | 4 | ○ | ○ | ○ | ○ | ○ | ○ |
| | | | | 8 | ○ | ○ | ○ | ○ | ○ | ○ |
| 12 | 8 | 4 | 2.5 | 1 | X | X | X | X | Δ | ○ |
| | | | | 6 | X | X | Δ | Δ | Δ | ○ |
| | | | | 12 | X | Δ | Δ | Δ | ○ | ○ |
| 16 | 8 | 4 | 2.5 | 1 | X | X | X | X | X | Δ |
| | | | | 8 | X | X | X | X | X | ○ |
| | | | | 16 | X | X | X | X | Δ | ○ |

Referring to Table 4, the unit "ppm" for the fixing rates indicates the number of papers which are fed per minute. The fixing loads indicate absolute loads applied to the papers 9 by the pressure rollers 8 and the resin films 7. "$Al_2O_3$" and "AlN" indicate that alumina and aluminum nitride sintered bodies were employed as the materials for the ceramic substrates 1 respectively. "FIG. 1", "FIG. 2" and "FIG. 3" indicate that fixing tests were made through the samples of the ceramic heaters shown in these figures respectively. "20 W/mK" and "170 W/mK" indicate the heat conductivity values of the ceramic substrates 1. The fixability levels were evaluated on first, second, fourth, sixth, eighth, twelfth and sixteenth papers fed to each heating/fixing unit. The first paper was fed to each heating/fixing unit after 15 seconds from power supply to the ceramic heater 10.

As to the evaluation of the fixability levels, "○", "Δ" and "×" indicate that the toner formed on each paper was hardly separated, separated by about 50%, and almost entirely separated by manual rubbing respectively. As clearly understood from Table 4, the samples of the inventive ceramic heaters in the structures shown in FIGS. 1 and 2 exhibited excellent fixability also when the fixing rates were increased. The fixability levels were further improved by changing the material for the ceramic substrates from alumina to alumina nitride for forming ceramic substrates having high heat conductivity.

In the structure of the conventional ceramic heater (FIG. 7) employing an alumina substrate, it is necessary to increase the width $W_3$ of the contact part by increasing the fixing load as the fixing rate is increased, as shown in Table 1. In the structure of FIG. 7 employing an alumina substrate, transition of the fixability level with respect to the load reflects such situation, as shown in Table 4. At a fixing rate of 8 ppm, for example, the fixability level "○" is attained only when the load is 8 kg and the width $W_3$ of the contact part is 4 mm. It is understood that no necessary fixability levels can be attained under the load condition of 8 kg at fixing rates of 12 ppm and 16 ppm.

In case of employing an aluminum nitride substrate, on the other hand, the fixability level of "○" is readily attained in the structure of the conventional ceramic heater (FIG. 7) when the fixing rate is 8 ppm, even if the load is 4 kg (the width $W_3$ of the contact part is 2 mm). This is conceivably because the width of an actual soaking part varies with the heat radiation property regardless of the width of the contact part.

Table 5 shows power consumed before complete fixation of the first paper, the transfer material, which was measured with an integrating wattmeter as to each condition. Referring to each column of Table 5, the left values indicate those of power consumption required for temperature rise, and right values show those required for fixation respectively.

As clearly understood from Table 5, aluminum nitride substrates exhibit smaller power consumption values in temperature rise as compared with alumina substrates under common fixing rates, fixing loads and fixability levels, due to small thermal capacity levels. Under common fixing rates, fixing loads and fixability levels, further, the power consumption values in fixation are successively increased in order of FIG. 7>FIG. 1>FIG. 2 regardless of the substrate materials. This is because the temperature distribution levels of the heaters within the widths of the contact parts are increased in order of FIG. 7>FIG. 1>FIG. 2, and hence power consumption is slightly reduced in the ceramic heater shown in FIG. 2 having uniform temperature distribution.

When the ceramic substrates are made of alumina, fixability levels are deteriorated as the fixation rates are increased even if power consumption levels are increased, due to high temperature distribution. When the ceramic substrates are made of aluminum nitride, on the other hand, heat can be effectively transmitted due to uniform temperature distribution in the substrates and small heat resistance, and the power consumption levels are reduced in order of FIG. 7>FIG. 1>FIG. 2.

Influences exerted by heat conductivity values on fixability levels were then investigated. The fixability levels were evaluated similarly to the above. In this case, the fixing rate and the fixing pressure were set at 8 ppm and 4 kg respectively. Similarly to the above, the fixability levels were evaluated on first, fourth and eighth papers in each sample. Table 6 shows the results.

TABLE 6

| Substrate Material | | $Al_2O_3$ | AlN | AlN | AlN | AlN | AlN |
|---|---|---|---|---|---|---|---|
| Heat Conductivity | | 20 W/mK | 30 W/mK | 50 W/mK | 100 W/mK | 170 W/mK | 250 W/mK |
| 8 ppm 4 kg | 1 | X | X | Δ | ○ | ○ | ◎ |
| | 4 | Δ | Δ | Δ | ○ | ○ | ◎ |
| | 8 | Δ | Δ | Δ | ○ | ◎ | ◎ |

As clearly understood from Table 6, preferable heat conductivity levels of the ceramic substrates were at least 50 W/mK, and the fixability levels were improved as the heat conductivity values were increased. Referring to Table 6, "◎" indicates that a toner formed on each paper was not in the least separated.

Aluminum nitride sintered bodies each having a mean particle diameter of 5.5 μm, flexural strength of 42 kg/mm$^2$ and heat conductivity of 170 W/mK were prepared by forming sheets with various sintering assistants and sintering the sheets at a temperature of 1700° C., to prepare substrates of 300 mm by 10 mm by 0.7mm, similarly to the above. The ten-point average height roughness of the surface of each substrate was 2 μm. Respective printed/baked layers includ-

TABLE 5

| Fixing Rate | Fixing Load | $Al_2O_3$ | | | | | | AlN | | | | | |
|---|---|---|---|---|---|---|---|---|---|---|---|---|---|
| (ppm) | (kg) | FIG. 7 | | FIG. 1 | | FIG. 2 | | FIG. 7 | | FIG. 1 | | FIG. 2 | |
| 4 | 4 | 1.0 | 0.50 | 1.01 | 0.49 | 1.01 | 0.48 | 0.83 | 0.49 | 0.75 | 0.46 | 0.74 | 0.45 |
| 8 | 4 | 1.10 | 0.50 | 1.10 | 0.49 | 1.10 | 0.48 | 0.91 | 0.49 | 0.88 | 0.46 | 0.86 | 0.45 |
| | 8 | 1.10 | 0.50 | 1.10 | 0.49 | 1.10 | 0.48 | 0.85 | 0.49 | 0.83 | 0.46 | 0.82 | 0.45 |
| 12 | 8 | 1.20 | 0.50 | 1.20 | 0.49 | 1.20 | 0.48 | 0.98 | 0.49 | 0.95 | 0.46 | 0.90 | 0.44 |
| 16 | 8 | 1.32 | 0.50 | 1.32 | 0.49 | 1.32 | 0.48 | 1.10 | 0.49 | 1.07 | 0.46 | 1.01 | 0.44 |

ing heat generators containing noble metals such as Ag or Pt, electrode layers containing Ag and temperature detector circuits of Ag—Pd were formed on the substrates followed by baking of protective glass layers, similarly to the above. In this state, both of longitudinal warpage and waviness were not more than 1 mm in each substrate. Such heater units were employed to form samples of the heating/fixing units shown in FIGS. 1, 2 and 7 similarly to the above, for confirming fixability levels of these heaters similarly to the above. Consequently, improvements from "×" to "Δ" and from "Δ" to "603 " were observed in followability (degree of improvement of fixing strength in an early stage) particularly at a fixing rate of 12 ppm and fixing pressure of 8 kg, as compared with the AlN data shown in Table 4.

Example 2

Samples of the bulk heater shown in FIG. 3C were subjected to evaluation of fixability levels for toners similarly to Example 1. Each bulk heater was prepared as follows:

Powder serving as a prescribed conductor component was added to and mixed with AlN powder and thereafter sheet-formed by a doctor blade coater. Thus, a heat generator 2 was formed. On the other hand, a ceramic substrate 1 of AlN was sheet-formed in a similar manner to Example 1, with no addition of conductor powder. These sheets were stacked with each other and cut into prescribed dimensions, and thereafter degreased in a non-oxidizing atmosphere at a temperature of 600° to 900° C. Alternatively, the degreasing may be performed in an oxidizing atmosphere such as the atmosphere at a temperature of not more than 600° C. The degreased sheet was fired in a non-oxidizing atmosphere at a temperature of 1700 to 1900° C. In the obtained sintered body, thicknesses corresponding to those of the heat generator 2 and the ceramic substrate 1 were 0.3 mm and 0.4 mm respectively. The total thickness was 0.7 mm. This sintered body was cut into dimensions of 300 mm by 10 mm.

On the other hand, an $Al_2O_3$ substrate of 150 mm by 8 mm by 0.3 mm was prepared. A prescribed circuit was formed on this substrate, and a thermistor serving as a temperature detector was mounted. The substrate employed herein may simply be capable of ensuring insulation between the same and a heat generator, and may alternatively be prepared from $ZrO_2$, glass or AlN. Further, a conductor employed for forming the circuit may simply have conductivity. However, the conductor is preferably prepared from a metal which is hard to oxidize such as a noble metal such as Ag, Au or Pt, or an alloy thereof, since the circuit is formed in the vicinity of the heat generator. A thermistor substrate prepared in the aforementioned manner was mounted on the heat generator, and subjected to a test for toner fixability. Table 7 shows the results.

TABLE 7

| Content of Conductor Component (%) | 10 | 20 | 30 | 50 | 70 | 80 |
|---|---|---|---|---|---|---|
| SiC | X | X | X | Δ | ○ | ○ |
| Mo | X | X | Δ | Δ | ○ | ○ |
| $MoSi_2$ | X | X | Δ | ○ | ○ | ○ |
| W | X | X | Δ | Δ | ○ | ○ |
| TiC | X | X | X | Δ | ○ | ○ |
| TiN | X | X | X | Δ | ○ | ○ |
| $TiB_2$ | X | X | X | Δ | ○ | ○ |
| ZrN | X | X | X | Δ | ○ | ○ |
| $ZrB_2$ | X | X | X | Δ | ○ | ○ |
| VN | X | X | X | Δ | ○ | ○ |
| NbN | X | X | X | Δ | ○ | ○ |
| $TiB_2 + ZrB_2$ | X | X | X | Δ | ○ | ○ |

The fixability evaluation test was made under fixing pressure of 4 kg and a fixing rate of 8 ppm. As clearly understood from Table 7, the fixability levels were improved by increasing the contents of the conductor components.

Example 3

Substrates having lengths of 300 mm, thicknesses of 0.7 mm and various widths shown in Table 8 were prepared from aluminum sintered bodies of 5.5 μm in mean particle diameter, 42 kg/mm$^2$ in flexural strength and 170 W/mK in heat conductivity obtained by the sheet forming method of Example 1. Surfaces of the substrates were finished into 2 μm in ten-point average height roughness Rz. Heat generators, electrodes and temperature detector electric circuit layers were baked to the ceramic substrates of various widths similarly to Example 1, to prepare samples of the ceramic heater shown in FIG. 1.

Samples of the heating/fixing unit shown in FIG. 1 were formed by these ceramic heater samples. Fixability levels for toners with respect to papers were evaluated through the respective heating/fixing unit samples under conditions of fixing rates and fixing loads shown in Table 8 in a similar procedure to that in Example 1. Further, power consumption required for fixing the first paper in each sample was measured in a similar procedure to that in Example 1. Table 8 shows the results. As to the column "power consumption" in Table 8, the left values indicate those of power consumption required for temperature rise, and the right values those required for fixation respectively. The fixability levels are indicated similarly to Table 4.

TABLE 8

| Fixing Rate (ppm) | Fixing Load (kg) | Substrate Width $W_2$ (mm) | No. | Contact Part Width $W_3$ (mm) | Substrate Width $W_2$ / Contact Width $W_3$ | Fixability | Power Consumption (Wh) | |
|---|---|---|---|---|---|---|---|---|
| 8 | 4 | 10 | 1 | 2 | 5 | ○ | 0.75 | 0.46 |
| | | | 2 | | | ○ | | |
| | | | 4 | | | ○ | | |
| | | 5 | 1 | 2 | 2.5 | ○ | 0.41 | 0.46 |
| | | | 2 | | | ○ | | |
| | | | 4 | | | ○ | | |

TABLE 8-continued

| Fixing Rate (ppm) | Fixing Load (kg) | Substrate Width $W_2$ (mm) | No. | Contact Part Width $W_3$ (mm) | Substrate Width $W_2$ / Contact Width $W_3$ | Fixability | Power Consumption (Wh) | |
|---|---|---|---|---|---|---|---|---|
| | | 2.8 | 1 | 2 | 1.4 | ○ | 0.29 | 0.46 |
| | | | 2 | | | ○ | | |
| | | | 4 | | ○ | | | |
| | | 2.0 | 1 | 2 | 1.0 | ○ | 0.25 | 0.45 |
| | | | 2 | | | ○ | | |
| | | | 4 | | | ○ | | |
| | | 1.6 | 1 | 2 | 0.8 | ○ | 0.22 | 0.45 |
| | | | 2 | | | ○ | | |
| | | | 4 | | | ○ | | |
| 12 | 10 | 10 | 1 | 6 | 1.67 | ○ | 0.92 | 0.46 |
| | | | 6 | | | ○ | | |
| | | | 12 | | | ○ | | |
| | | 8.5 | 1 | 6 | 1.42 | ○ | 0.82 | 0.46 |
| | | | 6 | | | ○ | | |
| | | | 12 | | | ○ | | |
| | | 6 | 1 | 6 | 1.0 | ○ | 0.69 | 0.45 |
| | | | 6 | | | ○ | | |
| | | | 12 | | | ○ | | |

Samples of the ceramic heater shown in FIG. 1 were formed by alumina substrates prepared in Example 1 and fixability levels were evaluated on substrates having various widths. The fixability level was "×" when the substrate width was not more than 5 mm under a fixing rate of 8 ppm and a fixing load of 4 kg, while the fixability level of "○" was confirmed up to a substrate width of 6 mm (in this case, the width of the contact part was 4 mm, and the ratio of the width of the substrate to that of the contact part was 1.5) when the load was increased to 8 kg. Under a condition of a fixing rate of 12 ppm, it was impossible to fix the toner even if the substrate width was increased to 10 mm.

From the aforementioned results, it is understood possible to ensure prescribed fixability even if the substrate width is smaller than the conventional standard width (Table 1) under a common fixing rate and a common fixing load by preparing the ceramic heater shown in FIG. 1 from a substrate material of aluminum nitride in accordance with the present invention.

Referring to the ratio of the substrate width to the contact part width, this ratio is reduced to 1.5 at the minimum in a ceramic heater employing an alumina substrate in order to ensure prescribed fixability, while it is understood that prescribed fixability can be ensured even if the ratio is reduced to below 1.4, when the ceramic heater is prepared from an aluminum nitride substrate according to the present invention.

It is also understood that power consumption can be considerably reduced by reducing the width of the ceramic substrate thereby reducing the heat capacity of the ceramic heater itself.

On the other hand, a sample of the ceramic heater having the structure shown in FIG. 7 was prepared from the aforementioned alumina substrate, and its fixability was similarly evaluated under the aforementioned conditions. Consequently, the lower limit of the substrate width capable of ensuring the fixability level of "○" was 2.0 mm when the fixing rate was 8 ppm and the fixing load was 4 kg, while the fixability level was "Δ" or "×" when the substrate width was 1.6 mm. The power consumption evaluated similarly to the above was increased by about 4 to 11% under fixing conditions corresponding to those in Table 8.

Example 4

Substrates having lengths of 300 mm, widths of 9 mm and various thicknesses shown in Table 9 were prepared from the same aluminum sintered bodies as those employed in Example 3. Heat generators of 1.5 mm in width, electrodes and temperature detector electrode circuit layers were baked on these substrates similarly to Example 1, to prepare samples of the ceramic heaters shown in FIGS. 1 and 7. Further, samples of the heating/fixing units shown in FIGS. 1 and 7 were prepared from these ceramic heater samples.

The respective heating/fixing unit samples were subjected to evaluation of fixability levels for toners with respect to papers. Under conditions of a fixing rate of 16 ppm and a fixing load of 13 kg, fixability levels were evaluated similarly to Example 1, except that 1000 papers were fed in this Example, and values of power consumption required for fixing the first papers were measured. Table 9 shows the results.

Referring to the column of the heater structure in Table 9, "FIG. 7" indicates heating/fixing unit samples prepared from the samples of the ceramic heater shown in FIG. 7, and "FIG. 1" indicates heating/fixing unit samples prepared from the samples of the ceramic heater shown in FIG. 1 according to the present invention.

TABLE 9

| Heater Structure | Substrate Thickness (mm) | Heat Generator Width (mm) | Fixability | Power Consumption (Wh) in Temperature Rise | Power Consumption (Wh) in Fixation |
|---|---|---|---|---|---|
| FIG. 7 | 0.7 | 0.5 | ○ | 0.92 | 0.47 |
| FIG. 7 | 0.6 | 0.5 | ○ | 0.84 | 0.45 |
| FIG. 7 | 0.4 | 0.5 | ○ | 0.65 | 0.43 |
| FIG. 7 | 0.3 | unintegrable as heater due to remarkable warpage | | | |
| FIG. 1 | 0.7 | 0.5 | ○ | 0.85 | 0.43 |
| FIG. 1 | 0.6 | 0.5 | ○ | 0.77 | 0.41 |
| FIG. 1 | 0.4 | 0.5 | ○ | 0.60 | 0.41 |

From the results shown in Table 9, it has been understood possible to maintain a prescribed fixability level even if a thin substrate having a thickness of not more than 0.635 mm (the standard thickness of the conventional substrate) is employed, with no damage of the substrate. The lower limit of the substrate thickness was 0.4 mm.

It has also been understood that the power consumption in temperature rise can be reduced by about 8% in case of employing the ceramic heater of the structure shown in FIG. 1 as compared with that of the structure shown in FIG. 7.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heater being provided on a heating/fixing unit comprising a movably arranged heat-resistant film and a pressure roller for applying pressure onto said heat-resistant film for fixing a toner image being formed on a surface of a transfer material being held between and moving along said heat-resistant film and said pressure roller due to pressurization by said pressure roller and heating through said heat-resistant film so that said heat-resistant film is slidable on said heater to be in close contact therewith, said heater comprising:

a ceramic substrate being arranged to face said surface of said transfer material being provided with said toner image; and a heat generator being formed on a surface of said ceramic substrate being opposite to that facing said surface of said transfer material.

2. The heater in accordance with claim 1, wherein said heat generator is provided in the form of a plurality of lines on said surface of said ceramic substrate.

3. The heater in accordance with claim 1, wherein said heat generator is provided in the form of a surface on said surface of said ceramic substrate.

4. The heater in accordance with claim 2, wherein said heat generator is made of a complex containing at least one metal being selected from a group consisting of silver, platinum, palladium, ruthenium and alloys thereof as a heat generator component.

5. The heater in accordance with claim 2, wherein said heat generator is made of a complex containing at least one component being selected from a group consisting of a carbide of Si, simple elements belonging to the group IVa, Va and VIa of the periodic table, and carbides, nitrides, borides and silicides of said elements as a heat generator component.

6. The heater in accordance with claim 1, wherein the heat conductivity of said ceramic substrate is at least 50 W/mK.

7. The heater in accordance with claim 6, wherein the thickness of said ceramic substrate is at least 0.4 mm and not more than 0.6 mm.

8. The heater in accordance with claim 6, wherein the ratio ($W_2/W_3$) of the width ($W_2$) of said ceramic substrate to the width ($W_3$) of a contact part being defined between said heat-resistant film and said pressure roller is not more than 1.4.

9. The heater in accordance with any of claim 1, wherein said ceramic substrate is mainly composed of aluminum nitride.

10. The heater in accordance with claim 1, wherein a control circuit and/or a control element for controlling the temperature of said heater is formed on said surface of said ceramic substrate being provided with said heat generator.

11. The heater in accordance with claim 1, wherein an element for detecting the temperature of said heater and/or its control circuit is formed on a substrate being different from said ceramic substrate, said substrate being provided immediately above said heat generator.

12. The heater in accordance with any of claim 1, wherein said ceramic substrate consists of an aluminum nitride sintered body, the mean diameter of particles forming said aluminum sintered body is not more than 6.0 μm, and the flexural strength of said aluminum nitride sintered body is at least 40 kg/mm$^2$.

13. A heating/fixing unit comprising:

a ceramic heater;

a heat-resistant film sliding in close contact with said ceramic heater; and a pressure roller for applying pressure onto said heat-resistant film, for fixing a toner image being formed on a surface of a transfer material being held between and moving along said heat-resistant film and said pressure roller due to pressurization by said pressure roller and heating by said ceramic heater through said heat-resistant film, said ceramic heater including:

a ceramic substrate being arranged to face said surface of said transfer material being provided with said toner image, and a heat generator being formed on a surface of said ceramic substrate being opposite to that facing said surface of said transfer material.

* * * * *

UNITED STATES PATENT AND TRADEMARK OFFICE
CERTIFICATE OF CORRECTION

PATENT NO. : 5,732,318

DATED : Mar. 24, 1998

INVENTOR(S) : Natsuhara et al.

It is certified that error appears in the above-identified patent and that said Letters Patent is hereby corrected as shown below:

Col. 2, line 65, after "alumina" replace "($Al_2$0$_3$)" by --($Al_2O_3$)--.
Col. 3, line 67, after "ppm." replace "0n" by --On--.
Col. 6, line 15, after "IVa," replace "va and iVa" by --Va and IVa--;
line 51, after "employing" replace "$Al_2$0$_3$" by --$Al_2O_3$--;
line 65, after "temperature" replace "= $1\text{-}e^{-1/Rc}$" by --= $1\text{-}e^{1/RC}$--.
Col.11, line 7, after "thickness" replace "$t_o$" by --$t_0$--;
line 12, after "thickness" replace "$t_o$" by --$t_0$--;
line 16, after "thickness" replace "$t_o$" by --$t_0$--.
Col. 17, line 11, after "to" replace " "603" " by --"○"--.
Col. 19, Table 8-continued, col. 6, under the heading "Contact Width $W_3$", line 2, delete "○";
col. 7, under the heading "Fixability", line 3, insert "○".

Signed and Sealed this

Twenty-sixth Day of May, 1998

*Attest:*

*Attesting Officer*

BRUCE LEHMAN

*Commissioner of Patents and Trademarks*